US009822597B2

(12) United States Patent
Carisella

(10) Patent No.: US 9,822,597 B2
(45) **Date of Patent: *Nov. 21, 2017**

(54) HYBRID DUMP BAILER AND METHOD OF USE

(71) Applicant: James V. Carisella, Harahan, LA (US)

(72) Inventor: James V. Carisella, Harahan, LA (US)

( * ) Notice: Subject to any disclaimer, the term of this patent is extended or adjusted under 35 U.S.C. 154(b) by 559 days.

This patent is subject to a terminal disclaimer.

(21) Appl. No.: 14/333,178

(22) Filed: Jul. 16, 2014

(65) Prior Publication Data

US 2014/0326465 A1 Nov. 6, 2014

Related U.S. Application Data

(63) Continuation of application No. 12/975,758, filed on Dec. 22, 2010, now Pat. No. 8,813,841.

(51) Int. Cl.
*E21B 27/02* (2006.01)

(52) U.S. Cl.
CPC ..... *E21B 27/02* (2013.01)

(58) Field of Classification Search
CPC ..... E21B 27/02
See application file for complete search history.

(56) References Cited

U.S. PATENT DOCUMENTS

| | | | |
|---|---|---|---|
| 1,476,747 | A | 12/1923 | Wolever |
| 2,141,179 | A | 12/1938 | Ennis |
| 2,526,021 | A | 10/1950 | Fultz |
| 2,618,345 | A | 11/1952 | Tucker |
| 2,653,666 | A | 9/1953 | Baker |
| 2,695,065 | A | 11/1954 | Baker et al. |
| 3,125,162 | A | 3/1964 | Briggs, Jr. et al. |
| 3,186,485 | A | 6/1965 | Owen |
| 3,199,597 | A | 8/1965 | Kelly |
| 3,294,171 | A | 12/1966 | Kelley |
| 3,378,078 | A | 4/1968 | Current |
| 3,650,325 | A | 3/1972 | Owens |
| 3,891,034 | A | 6/1975 | Owen et al. |
| 4,696,343 | A | 9/1987 | Anderson et al. |
| 4,741,396 | A | 5/1988 | Falxa |
| 4,739,829 | A | 8/1988 | Brunner |
| 5,033,549 | A | 7/1991 | Champeaux et al. |
| 5,052,489 | A | 10/1991 | Carisella et al. |
| 5,070,788 | A | 12/1991 | Carisella |
| 5,115,860 | A | 5/1992 | Champeaux et al. |

(Continued)

OTHER PUBLICATIONS

Schlumberger Oilfield Glossary entry for "dump bailer", accessed Jul. 23, 2013 via www.glossary.oilfield.slb.com.

(Continued)

*Primary Examiner* — Blake E Michener
(74) *Attorney, Agent, or Firm* — JL Salazar Law Firm

(57) ABSTRACT

A hybrid dump bailer is disclosed herein comprising a bailer tubes for containing a material, such as cement slurry, to be dumped. The hybrid dump bailer comprises a pressure pulse piston that is accelerated by a spring causing a pressure pulse to expel the material to be dumped. The hybrid dump bailer further comprises a collet, a retaining rod, a piston, valve, and a supply of pressurized fluid which is holds the pressure pulse piston in place while the spring is compressed. Once the valve is opened, releasing the pressurized fluid, the retaining rod separates from the collet allowing the pressure pulse piston to accelerate can produce the pressure pulse to dump the material.

26 Claims, 10 Drawing Sheets

(56) References Cited

U.S. PATENT DOCUMENTS

| | | | |
|---|---|---|---|
| 5,115,865 | A | 5/1992 | Carisella |
| 5,159,145 | A | 10/1992 | Carisella |
| 5,159,146 | A | 10/1992 | Carisella |
| 5,240,077 | A | 8/1993 | Whitsitt |
| 5,392,856 | A | 2/1995 | Broussard et al. |
| 5,417,289 | A | 5/1995 | Carisella |
| 5,469,919 | A | 11/1995 | Carisella |
| 5,495,892 | A | 3/1996 | Carisella |
| 5,564,504 | A | 10/1996 | Carisella |
| 5,813,459 | A | 9/1998 | Carisella |
| 5,975,205 | A | 11/1999 | Carisella |
| 6,145,598 | A | 11/2000 | Carisella |
| 6,158,506 | A | 12/2000 | Carisella |
| 6,164,375 | A | 12/2000 | Carisella |
| 6,202,748 | B1 | 3/2001 | Carisella |
| 6,213,217 | B1 | 4/2001 | Wilson et al. |
| 6,223,820 | B1 | 5/2001 | Carisella |
| 6,305,477 | B1 | 10/2001 | Carisella et al. |
| 6,311,778 | B1 | 11/2001 | Carisella et al. |
| 6,318,461 | B1 | 11/2001 | Carisella |
| 6,341,654 | B1 | 1/2002 | Wilson et al. |
| 6,345,669 | B1 | 2/2002 | Buyers et al. |
| 6,354,372 | B1 | 3/2002 | Carisella et al. |
| 6,374,917 | B2 | 4/2002 | Carisella |
| 6,458,233 | B2 | 10/2002 | Carisella |
| 6,543,541 | B2 | 4/2003 | Buyers et al. |
| 7,000,705 | B2 | 2/2006 | Buyers et al. |
| 7,614,454 | B2 | 11/2009 | Buyers et al. |
| 7,703,511 | B2 | 4/2010 | Buyers et al. |
| 7,779,905 | B2 | 8/2010 | Carisella et al. |
| 8,025,105 | B2 | 9/2011 | Templeton et al. |
| 8,113,282 | B2 | 2/2012 | Picou |
| 8,191,645 | B2 | 6/2012 | Carisella |
| 8,534,367 | B2 | 9/2013 | Carisella |
| 8,813,841 | B2 | 8/2014 | Carisella |
| 9,080,405 | B2 | 7/2015 | Carisella |
| 9,476,272 | B2 | 10/2016 | Carisella |
| 2004/0084190 | A1 | 5/2004 | Hill et al. |
| 2006/0102336 | A1 | 5/2006 | Campbell |
| 2007/0012435 | A1 | 1/2007 | Obrejanu |
| 2009/0095466 | A1 | 4/2009 | Obrejanu |
| 2010/0122814 | A1 | 5/2010 | Picou |
| 2010/0155054 | A1 | 6/2010 | Innes et al. |
| 2011/0259607 | A1 | 10/2011 | Carisella |
| 2012/0247755 | A1 | 10/2012 | Colon et al. |
| 2014/0326465 | A1 | 11/2014 | Carisella |

OTHER PUBLICATIONS

HPI, et al., Chapter 2: Tubing & Thru-Tubing Bridge Plugs, High Pressure Integrity, Inc., www.hipitools.com, 2008 Weatherford, 35 pages.

HPI, et al., Chapter 3: Bailer Systems, High Pressure Integrity, Inc., www.hpitools.com, 2008 Weatherford, 44 pages.

Thru-Tubing Systems, et al., Wireline Products Catalog, Revised Feb. 12, 2014, 44 pages.

HYBRID DUMP BAILER AND METHOD OF USE

This application is a continuation of application Ser. No. 12/975,758, filed Dec. 22, 2010, which issued as U.S. Pat. No. 8,813,841.

TECHNICAL FIELD

This invention relates to a hybrid dump bailer for use in a wellbore, and a method of using a hybrid dump.

BACKGROUND OF THE INVENTION

In subterranean wells, such as oil and gas wells, there are occasions when material, such as cement slurry or other chemicals, need to be introduced into the well bore. One common example is the introduction of cement slurry into a well bore to seal the well bore or the introduction of cement slurry above a bridge plug to seal off a section of the well bore. This is typically accomplished by what is commonly known in the industry as a dump bailer. Dump bailers are introduced or carried into a subterranean well on a conduit, such as wire line, electric line, continuous coiled tubing, threaded work string, or the like, and discharge or "dump" the cement slurry into the well bore.

There are two general types of dump bailers: (1) gravity feed bailers and (2) positive displacement bailers. Gravity feed dump bailers are some of the most commonly used dump bailers in the industry. One reason for this is its simplicity. However, gravity dump bailers present many drawbacks. Chief among them is the possibility of "stringing," which occurs when the cement slurry does not completely discharge at the desired depth and the cement slurry is strung out through the well. Additionally, most gravity dump bailers include a seal, such as a ceramic disk, that is broken to allow the cement slurry to flow. The seal can be broken by a pin or, more frequently, shattered by an explosive charge. Positive displacement dump bailers address many of the deficiencies of the gravity dump bailers by elimination of the explosive charge and by providing force to expel the cement slurry out of the bailer.

There are several types of positive displacement dump bailers. Most positive displacement dump bailers rely on a sweep piston use to force the cement slurry or material out of the bailer. These systems may use a weight, either alone or with some actuating system, to force the piston down the bailer or the systems may use the pressure differential between atmospheric (well bore) pressure and the internal tool pressure to push the piston down the length of the bailer. While the positive displacement bailers overcome many of the deficiencies of the gravity dump bailers, they have several drawbacks. One of the main drawbacks is the use of bailer tubes, which hold the cement slurry. Because the sweep piston is forced through the bailer tubes, the bailer tubes must have a consistent inner diameter with a smooth wall bore to prevent the sweep piston from becoming lodged in the bailer tube and to reduce the friction between the pipe wall and the cement slurry. Additionally, because multiple bailer tubes are typically used, care must be taken not to damage the threaded connections. If the threaded connections are over tightened, the inner diameter of the bailer tube could neck down, causing the sweep piston to hang up.

Therefore there exists to address the shortcomings of the current art exists.

BRIEF SUMMARY OF THE INVENTION

In one aspect, the present invention utilizes a hybrid dump bailer for use in introducing material, such as cement slurry, into a well bore. The hybrid dump bailer includes a tool body having a longitudinal tool bore; at least one bailer tube; the bore including a piston with a seal rod and a pressure pulse piston with a connector rod and collet, wherein the collet has been configured to receive the seal rod; and a lower connection mechanism for connecting the tool body to bailer tubes. The dump bailer also includes a piston spring and a pressure pulse piston spring used to move the piston and pressure pulse piston.

Preferably, the hybrid dump bailer includes a head space above the piston and also includes a passageway, wherein the passageway is configured to allow fluid communication between the head space and tool body.

It is preferred that the hybrid dump bailer include a fluted connector, wherein the fluted connector and the lower tandem sub limits the travel of the pressure pulse piston.

It is also preferred that the hybrid dump bailer also includes a solenoid valve, wherein the solenoid valve can be remotely opened to allow fluid communication between the headspace and the upper solenoid housing.

In this aspect of the invention, the hybrid dump bailer also includes a plug, wherein the plug is secured in the bailer cage by a shear pin.

In another aspect, the present invention hybrid dump bailer includes a tool body having a longitudinal tool bore. The tool body also includes a top contact sub, a solenoid valve housing, a solenoid valve base, an inflow housing, a metering collet sub, a pressure chamber, a lower tandem sub, and a lower piston housing at least one bailer tube. The bore includes a piston with a seal rod and a pressure pulse piston with a connector rod and collet, wherein the collet has been configured to receive the seal rod; and an lower connection means for connecting the tool body to bailer tubes.

Preferably, the hybrid dump bailer also includes a piston spring and a pressure pulse piston spring.

It is also preferred that the hybrid dump bailer also includes a head space above the piston and a passageway through the solenoid valve base, wherein the passageway is configured to allow fluid communication between the head space and solenoid valve housing.

This aspect of the invention also includes a fluted connector, wherein the fluted connector and the lower tandem sub limit the travel of the pressure pulse piston.

It is also preferred that the hybrid dump bailer also includes a solenoid valve, wherein the solenoid valve can be remotely opened to allow fluid communication between the headspace and the upper solenoid housing.

The hybrid dump bailer also includes a plug, wherein the plug is secured in the bailer cage by a shear pin.

It is also preferred that the hybrid dump bailer where in the top contact sub, solenoid valve housing, solenoid valve base, inflow housing, metering collet sub, pressure chamber, lower tandem sub, and lower piston housing are connected by a threaded connection; however other connections such as welded connections are contemplated.

In another aspect, the invention provides a resetting tool for a hybrid dump bailer, which includes an inlet valve; a relief valve; a compression piston; and a compression rod.

Further aspects of the invention will be apparent from the following description.

DETAILED DESCRIPTION OF THE INVENTION

As used herein, "a" or "an" means one or more than one. Additional, distal refers to the end of the element closest to the setting mandrel of the setting tool and proximal end refers to the end of the element closest to the firing head of the setting tool.

The methods and apparatus of the present invention will now be illustrated with reference to FIGS. 1 through 5. It should be understood that these are merely illustrative and not exhaustive examples of the scope of the present invention and that variations which are understood by those having ordinary skill in the art are within the scope of the present invention.

Figure 1:
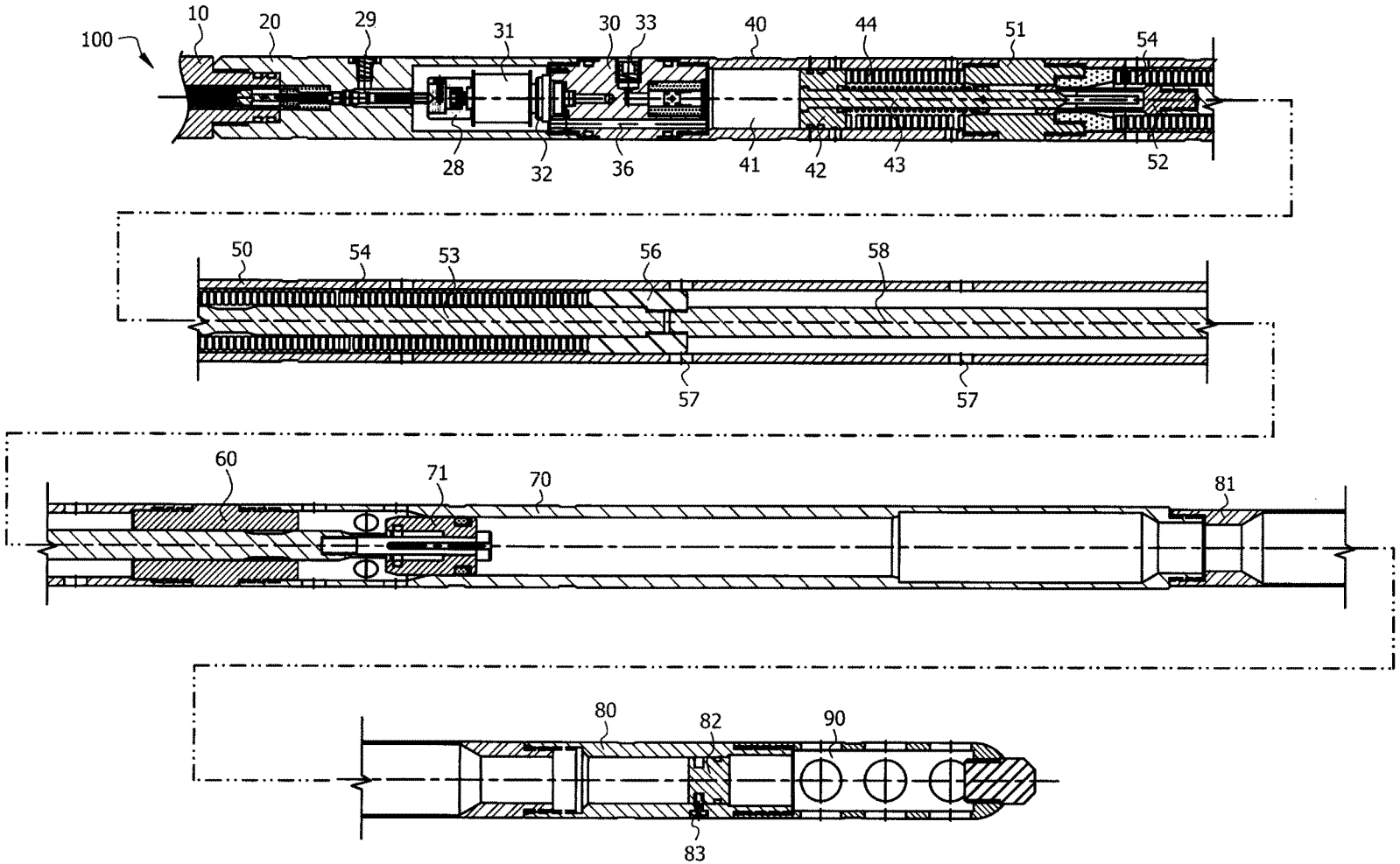
FIG. 1 schematically depicts one embodiment of the hybrid bailer of this invention in the ready to run position.

Turning now to FIG. 1, which shows hybrid bailer 100 loaded and energized to discharge cement slurry into a well bore. While this example will discuss the discharge of cement slurry into the well bore, it is also contemplated that the hybrid dump bailer 100 could be used to deposit other material such as sand and chemicals. The hybrid dump bailer 100 includes a tool body made up of top contact sub 10, solenoid valve housing 20, solenoid valve base 30, inflow housing 40, metering collet sub 51, pressure pulse chamber 50, lower tandem sub 60, and lower piston housing 70. Bailer tubes 81, bottom sub 80, and bailer cage 90 are also connected to the tool body to complete to hybrid dump bailer. Each section will be discussed in further detail below.

Figure 1A:
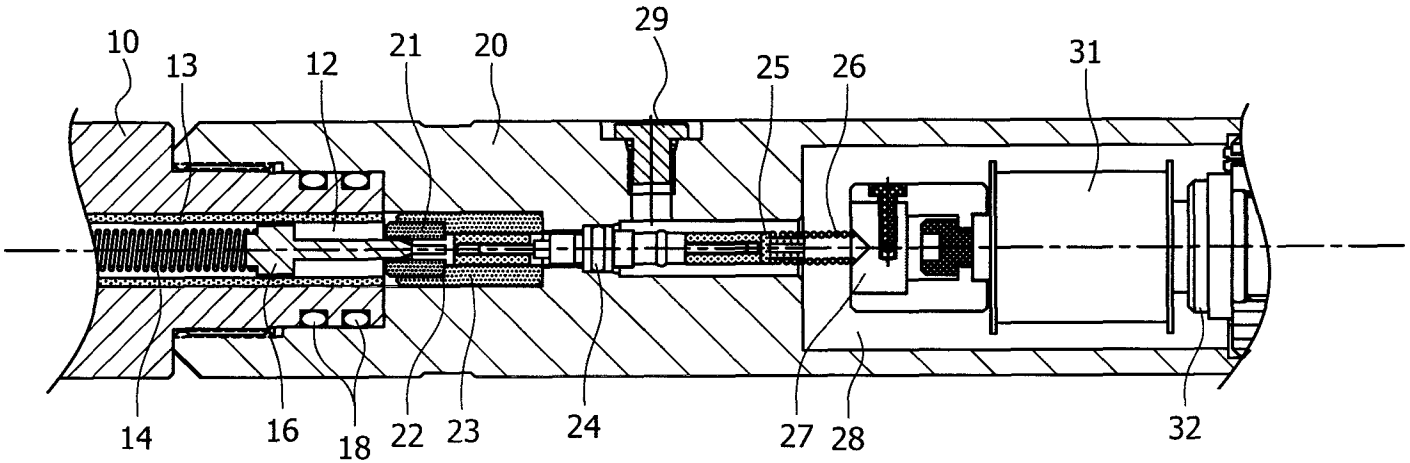
FIG. 1A schematically depicts a close up view of the contact sub and solenoid housing of the hybrid dump bailer of this invention.
Figure 1B:
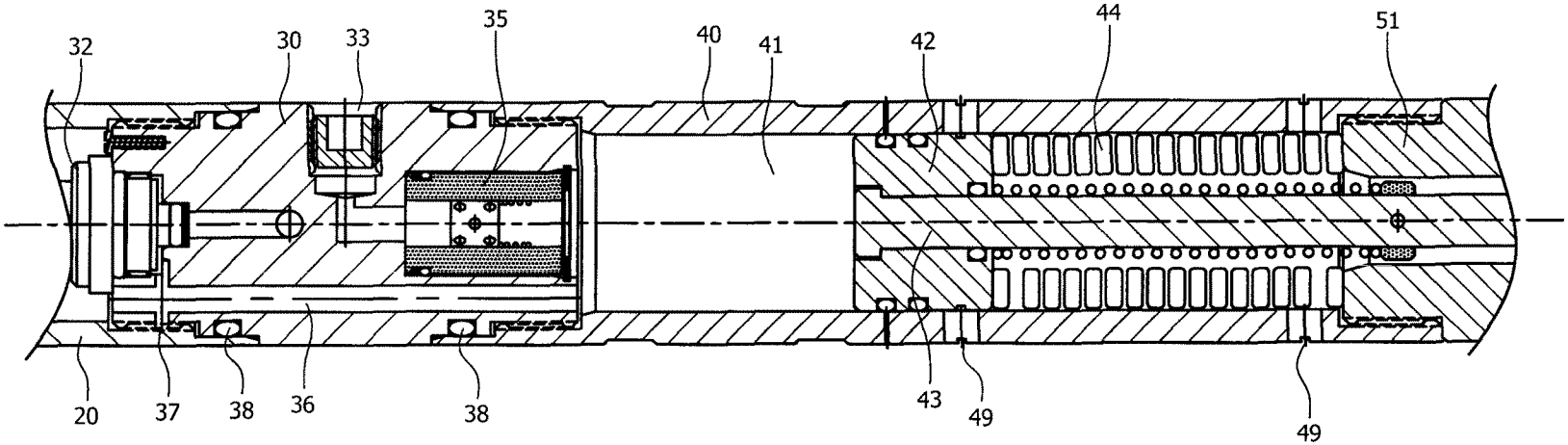
FIG. 1B schematically depicts a close up view of the solenoid valve base and the inflow housing of the hybrid dump bailer of this invention.

The top contact sub 10, which is shown in close-up in FIG. 1A, is connected to solenoid valve housing 20 by a threaded connection. While other connections, such as welded connections, are contemplated, the threaded connection is preferred because it allows the top contact sub to easily be removed for service or replacement. To further seal the connection, o-rings 18 are used. Polymer and copolymer o-rings such as Buna-N or nitrile rubber are preferred; however, other materials are contemplated and the selection will depend on the service conditions the hybrid dump bailers are exposed to. The top contact sub 10 includes a central bore 12, which houses a spring 14 and a contact pin 16. The central bore 12 is lined with an insulating material 13, such as polyether ether ketone ("PEEK"), to prevent top contact sub 10 from becoming energized. Other electrical insulators, such as ceramics, carbon, rubbers, and plastics, can also be used. When the top contact sub 10 is fully mated with solenoid valve housing 20, spring 14 is compressed as contact pin 16 is connected to electrical contact receptacle 21. The force exerted by compression of the spring 14, forces the contact pin 16 to seat within the receptacle of contact receptacle 21 thereby passing electrical current from contact pin 16 to receptacle 21.

Electrical contact receptacle 21 is located within solenoid valve housing 20 and is surrounded by PEEK insulator 23. As discussed above, other insulating material may be used. The receptacle is connected to brass contact 22. A ceramic electrical feed-thru 24 is connected to brass contact 22. Feed-thru 24 passes electrical current from brass contact 22 to flex spring contact 25 and flex spring 26, which is in contact with solenoid valve contact 27. Solenoid valve housing 20 also includes an opening, which is plugged by plug 29.

Solenoid valve base 30 and inflow housing 40 are shown in dose-up in FIG. IB. Solenoid valve base 30 is connected on top side to solenoid valve housing 20 and on the bottom side to inflow housing 40 by a threaded connection. As previously discussed other connection mechanisms, such as welded connections and the like, are contemplated; however, the threaded connection is preferred. Additionally, a-rings 38 are incorporated to seal the device. Solenoid valve base 30 has recess designed to receive solenoid valve 32, a side opening, which is plugged by plug 33, check valve 35, and a passageway 36. Check valve 35 is located in a passageway that provides fluid communication between the side opening and the bottom of solenoid valve base 30. When plug 33 is removed, fluid is allowed to pass through check valve 35 and into head space 4I, which is created by the bottom of solenoid valve base 30, inflow housing 40, and piston 42. Check valve 35 prevents flow of fluid from head space 4I through the check valve to the side opening.

Passageway 36 connects head space 4I with solenoid valve 32. When solenoid valve actuator 3I (see FIG. 1A) is energized, the solenoid valve 32 opens, allowing fluid to flow from head space 4I through passage way 36 and into head space 28 of solenoid valve housing 20 (see FIG. 1A). Passageway 36 also includes a side opening 37. When solenoid valve base 30 is completely connected to solenoid valve housing 20, side opening 37 is sealed. Solenoid valve housing 20 can be backed off from solenoid valve base 30, thus exposing side opening 37 to allow any pressure in head space 4I to be bled off, should, for example, solenoid valve 32 not function properly.

Figure 1C:
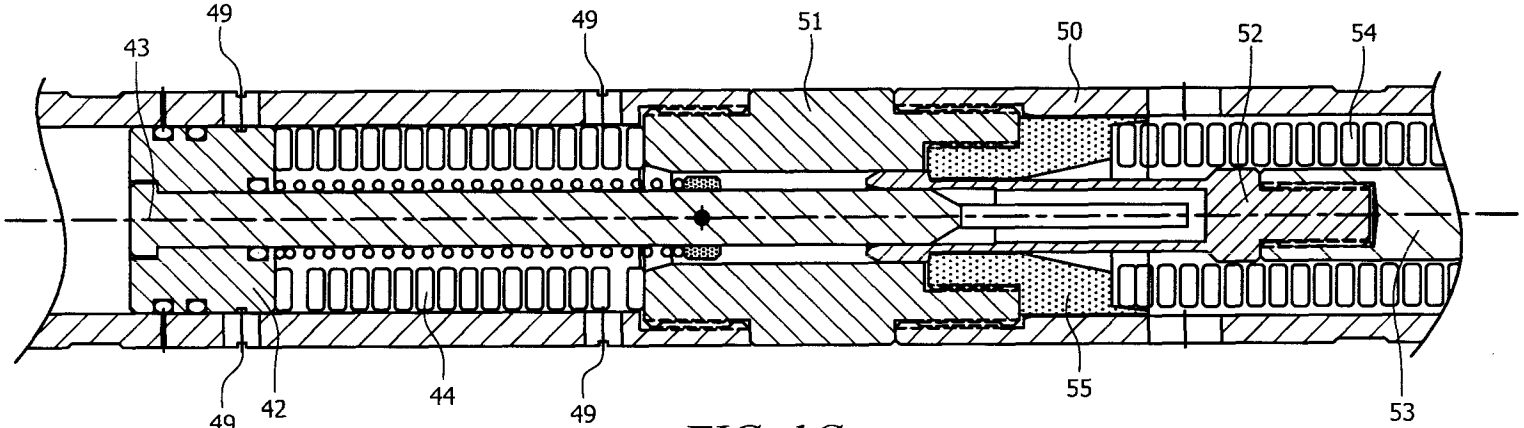
FIG. 1C schematically depicts a close up view of the metering sub and pressure pulse chamber of the hybrid dump bailer of this invention.

As shown in FIG. 1C, inflow housing 40 is connected on its other end to metering collet sub 51 via a threaded connection. As previously discussed, this is the preferred connection; however, other connections are contemplated. Inflow housing 40 also includes inflow passageway 49. This allows this section of bailer 100 to operate at atmospheric pressure. Piston 42, which is located within the centre bore of inflow hosing 40, is connected to seal rod 43. A piston spring 44 is positioned between piston 42 and metering collet sub 51.

Metering collet sub 5I has a central bore through which seal rod 43 passes. Seal rod 43 is designed to be received and held by collet 52. Plug 33 is removed and a fluid is pumped through check valve 35 into head space 41. Although hydraulic fluid is preferred, other fluids such as compressed air or other gases can be used. In normal operation, the pressure in head space 4I is increased to approximately 400 psig above ambient. This pressure provides the force necessary to push piston 42 down and compress piston spring 44, thus forcing seal rod 43 into collet 52.

The other end of metering collet sub 51 is connected by threaded connection to pressure pulse chamber 50. In addition to collet 52, pressure pulse chamber 50 includes upper connector rod 53, pressure pulse piston spring 54, collet base 55, fluted connector 56 (see, e.g. FIG. 1), inflow passageways 57 (see FIG. 1D), and lower connector rod 58. Collet 52 is connected to upper connector rod 53 via a threaded connection. The other end of upper connector rod 53 is connected to fluted connector 56 via a threaded connection. Again, other connection means, such as a welded connection, are contemplated; however a threaded connection is preferred to allow for ease of replacement of parts and assembly of the hybrid dump bailer. Pressure pulse piston spring 54 is located between collet base 55 and fluted connector 56. Pressure chamber inflow passageways 57, like inflow passageways 49, allow well bore fluid to enter bailer 100, thus equalizing the pressure difference between the well bore and the bailer. Because the pressure chamber is open to the atmosphere and well bore fluid is in the interior, connector 56 is fluted to allow fluid to flow past the connector.

Figure 1D:
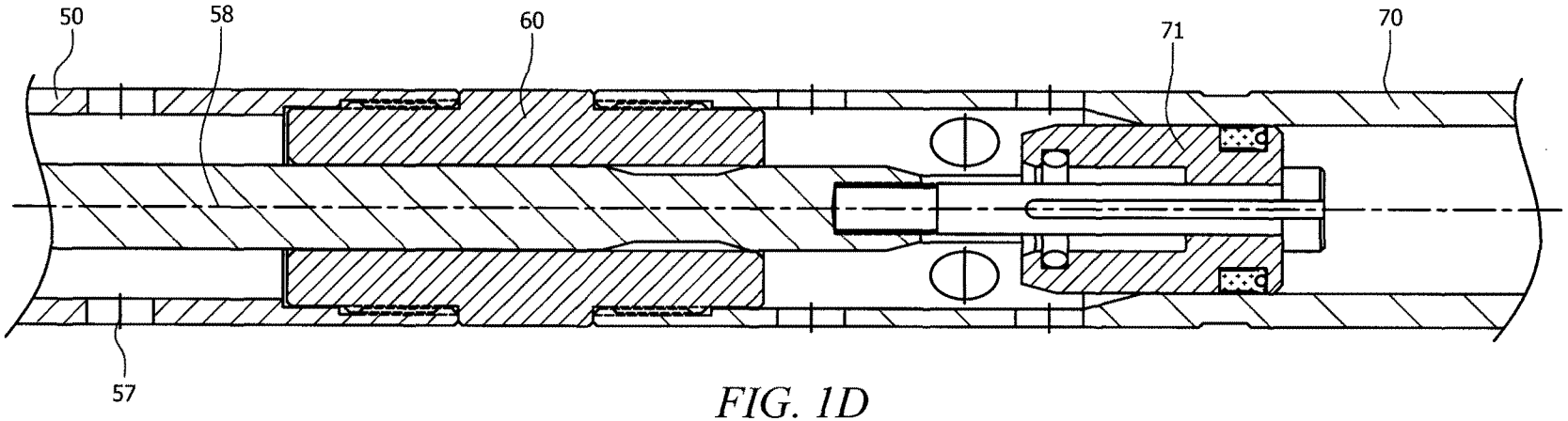
FIG. 1D schematically depicts a close up view of the tandem sub and lower pressure pulse chamber of the hybrid dump bailer of this invention.

Referring to FIG. 1D, lower connector rod 58 is connected to fluted connector 56 via a threaded connection. Lower connector rod 58 passes through tandem sub 60, which is connected on its upper end to pressure pulse chamber 50 and on its lower end to lower piston housing 70 via a threaded connection. Again, other connections are contemplated, but a threaded connection is preferred. The bottom end of lower connector rod 58 is connected to lower pressure pulse piston 71. Lower piston housing 70 is connected at its lower end via threaded connection to bailer tube 81. Depending on the amount of material to be introduced into the well bore, one or more bailer tubes may be connected.

One advantage of the invention is that the bailer tubes do not have to meet the exacting standards, nor do they need to be treated with as much care, as the prior art bailer tubes. The prior art bailer tubes had to be manufactured with exacting internal diameter tolerances because small restrictions in the inner diameter could cause mis-runs in gravity bailers. Moreover, in prior art positive displacement bailers, which force a piston through the bailer tubes to dump the cement, variances in the inner diameter, can cause the piston to hang up, also causing mis-runs. Further, extra care must be taken when making up a section of bailer tubes because over torqueing the connection can cause the inner diameter to narrow at the connection. The new design of this invention is not dependent on the consistency of the inner diameter. This allows the bailer tubes to be manufactured from less expensive material and methods.

Figure 1E:
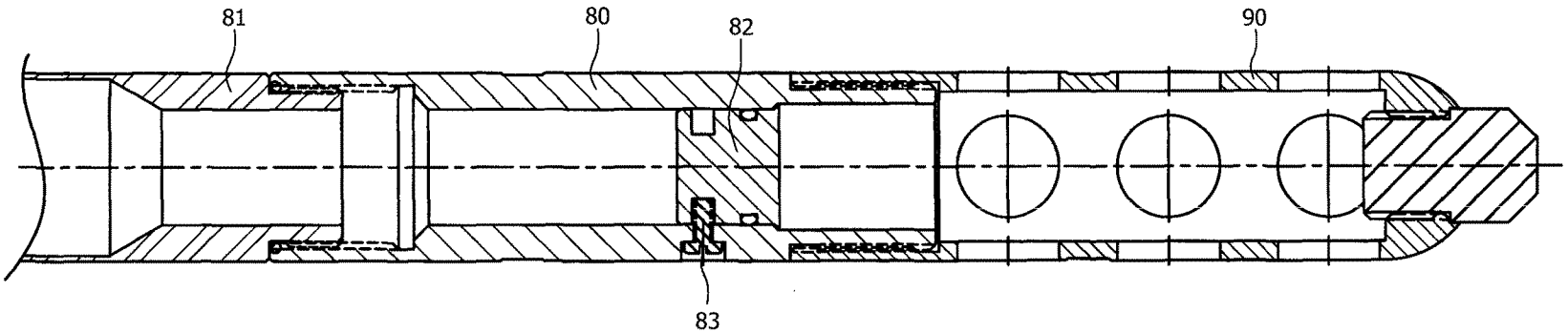
FIG. 1E schematically depicts a close up view of the lower sub and the bailer cage of the hybrid dump bail of this invention.
Figure 2:
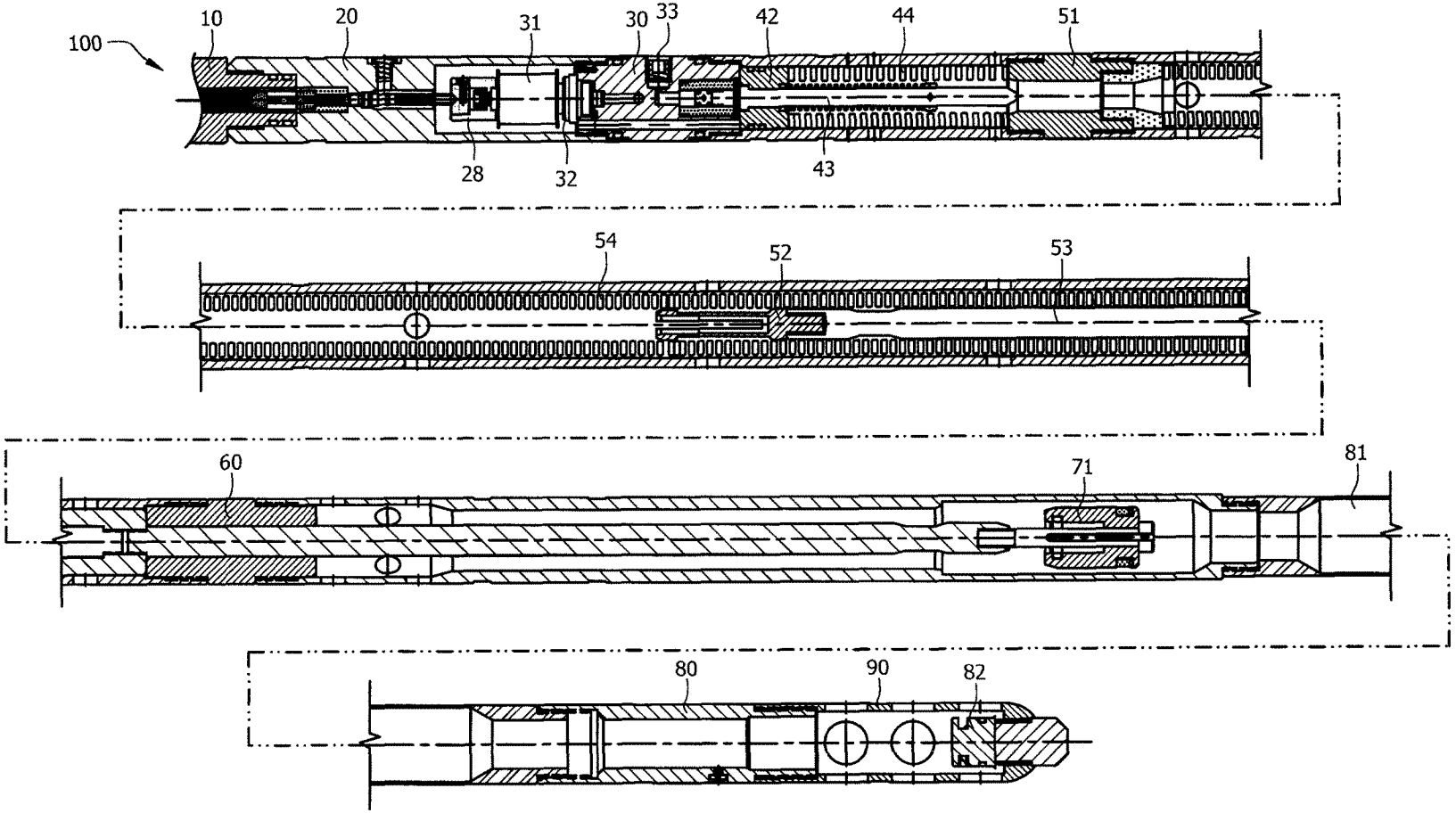
FIG. 2 schematically depicts one embodiment of the hybrid dump bailer of this invention after the tool has been run.

Referring to FIG. 1E, the last bailer tube 81 is connected to bottom sub 80. Bottom sub 80 has a plug 82. Plug 82 is attached to bottom sub 80 by shear pin 83. Shear pin 83 can be a screw or other pin which holds the plug in pace. In the preferred embodiment, shear pin 83 is a brass screw that has a hole drilled in the center of the screw to reduce the amount of shear force necessary to shear the screw to approximately 200-250 $lb_F$. Alternative materials, such as metal alloys and plastics can also be used as long as the shear force can be controlled. Bottom sub 80 is then connected to bailer cage 90. Bailer cage 90 includes many openings used to direct the dump material in the well. As shown in FIG. 2, bailer cage 90 also serves to capture plug 82 so it can be reused.

Referring back to FIG. 1, hybrid bailer 100 is shown in the ready-to-run position. In this position, hydraulic fluid, which has been pumped into head space 41, forces piston 42 down, compressing piston spring 44 between piston 42 and collet sub 51. Collet 52, which receives the distal end of seal rod 43, is a spring finger collet that grips the distal end of seal rod 43 when pressure pulse piston spring 54 is compressed between fluted connector 56 and collet base-sub 51. Depending on the amount of cement slurry to be dumped, a number of bailer tubes 81 containing cement slurry are attached to the lower piston housing 70. In the preferred embodiment, a water pad of the type know in the art is placed on top of the cement slurry.

Referring to FIG. 2, once hybrid bailer 100 is lowered into the well bore to the location were the cement slurry is to be dumped, solenoid valve 32 is opened, allowing the hydraulic fluid to flow from head chamber 41 through passageway 36 and into void space 28 of solenoid valve housing 20, thereby relieving the pressure in head space 41. This allows spring 44 to push piston 42 up, thereby disconnecting rod 43 from collet 52. Once rod 43 is disconnected from collet 52, spring 54 then forces fluted connector 56 down, thereby accelerating pressure pulse piston 71. As pressure pulse piston 71 accelerates it strikes the water pad creating a pressure pulse, or shock wave, that is transmitted to the cement slurry. The pressure pulse creates a force that shears shear pin 83, there by freeing plug 82, which travels to and is contained by the bottom of bailer cage 90.

Figure 3:
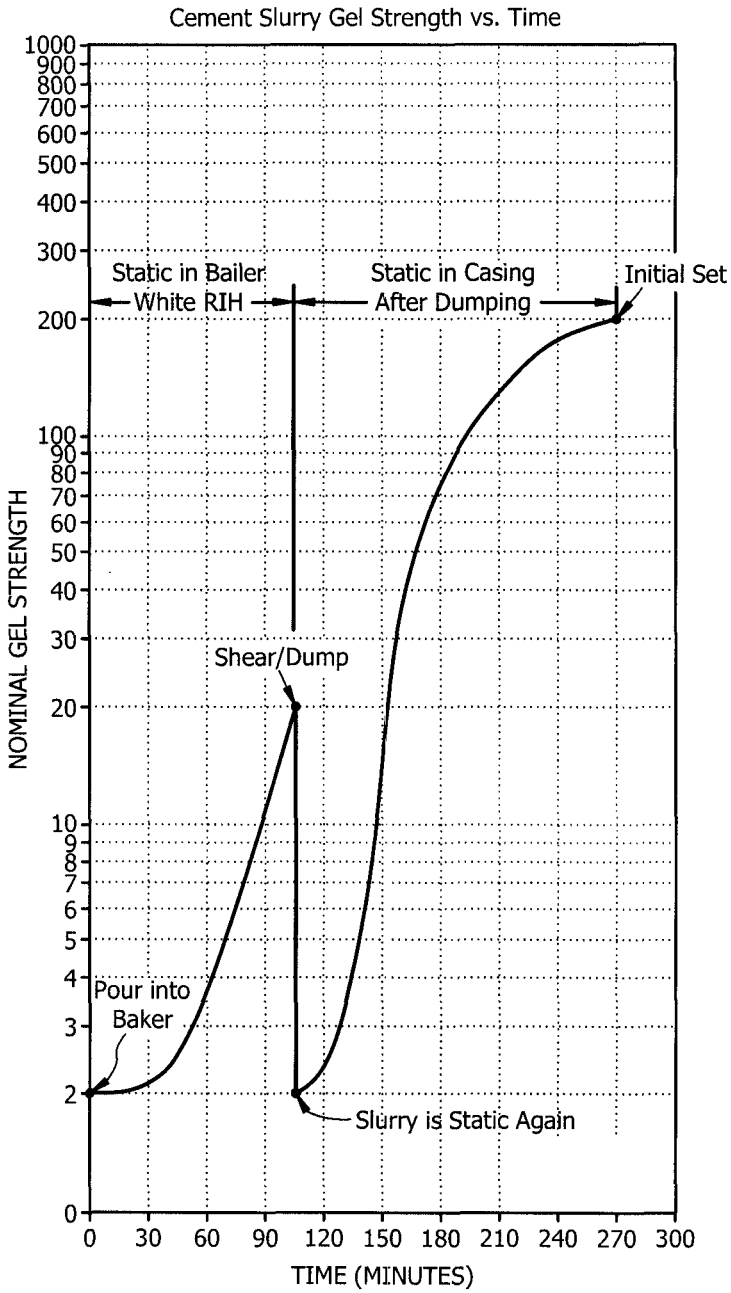
FIG. 3 shows a typical gel strength v. time curve for a cement slurry.

Once the cement slurry is mixed and added to the bailer tubes, the cement slurry begins to gel. This is due to a number of factors including: (1) the ionic charges from the various slurry components; (2) the density of the slurry; (3) the slurry remaining static in the bailer tubes; (4) the elevated temperatures and pressures the slurry is subject to prior to dumping; and (5) the long time delay between the time the slurry is mixed and the time it is dumped. Once the cement slurry begins to gel, it becomes static has a tendency to remain static. Thus, once the cement slurry gels, it resists flow. In gravity and positive displacement bailers, this is one of the most common causes of mis-runs and stringing of cement in the well bore. FIG. 3 shows a predicted cement slurry gel strength time curve. As shown in the time curve, once the cement slurry is mixed and poured into the bailer tube, it begins to quickly gain gel strength while the bailer is run in the well bore. It may take upwards of two hours from the time the cement is mixed before it is dumped into the well bore. Thus, to guarantee that the cement slurry will flow out of the dump bailer, pressure pulse piston 71 must create sufficient force to break the cement slurry gel. Once the gel is broken, the cement slurry has favorable rheological properties, allowing the cement slurry to flow out of bailer cage 90. FIG. 3 shows that once hybrid bailer 100 is dumped, the shock wave breaks the gel causing the gel strength to quickly drop. Once the cement slurry is in the well casing, it once again becomes static and the gel strength rapidly increases until the cement is set.

Once hybrid bailer 100 has dumped the cement slurry into the well bore, it is raised to the surface and bailer tubes 81 are removed. Bailer cage 90 is also removed, cleaned, and plug 82 is recovered and shear pin 83 is removed. Plug 82 is then inspected and, if there is no damage, it is reinstalled in bailer cage 90 using a new shear pin 83. Bailer tubes 81 are cleaned and inspected. Depending on the amount of cement slurry to be dumped, additional bailer tubes may be added or removed and the bailer tubes can then be refilled with cement slurry and a water pad.

Figure 4:
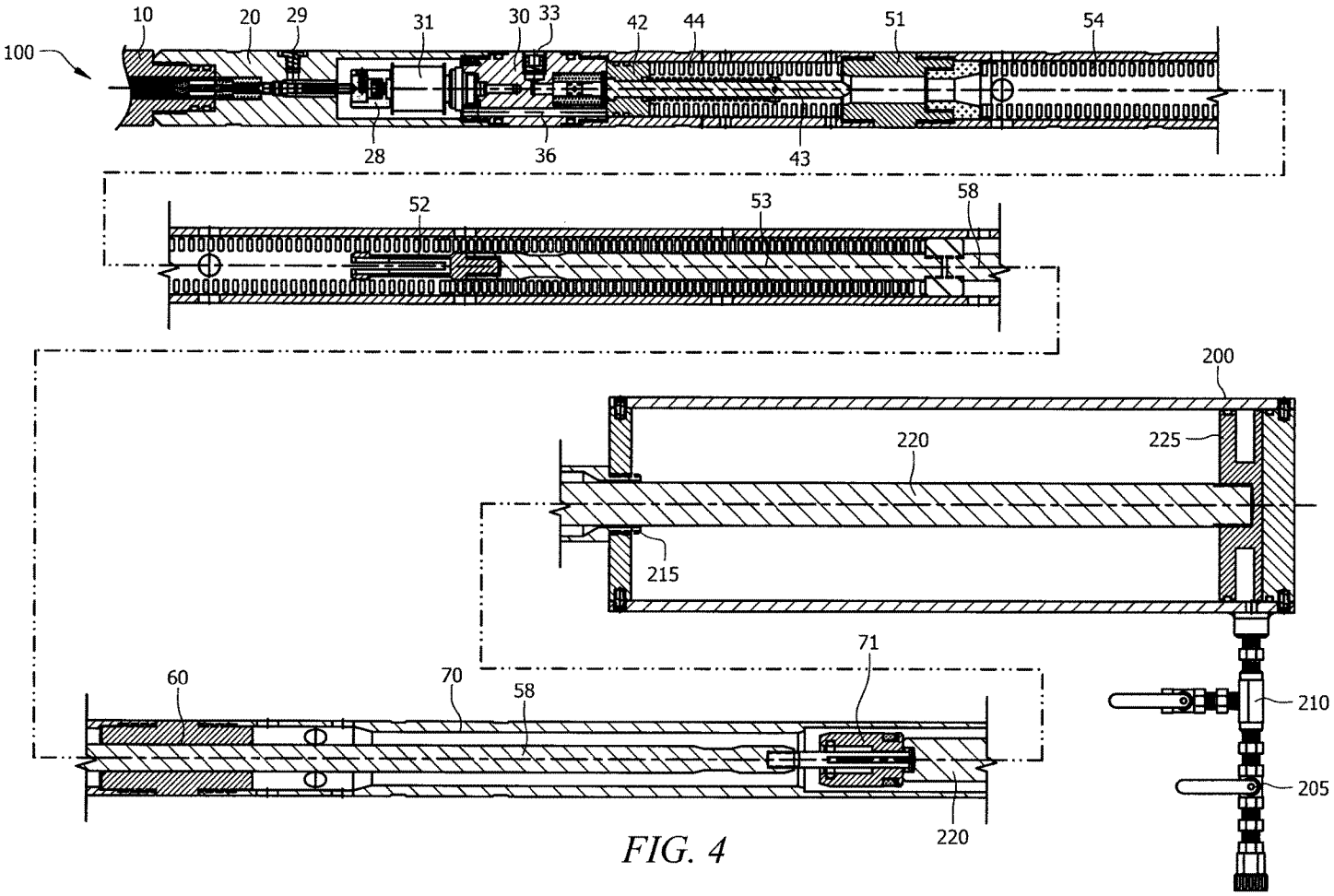
FIG. 4 schematically depicts the hybrid dump bailer and resetting tool of this invention.
Figure 5:
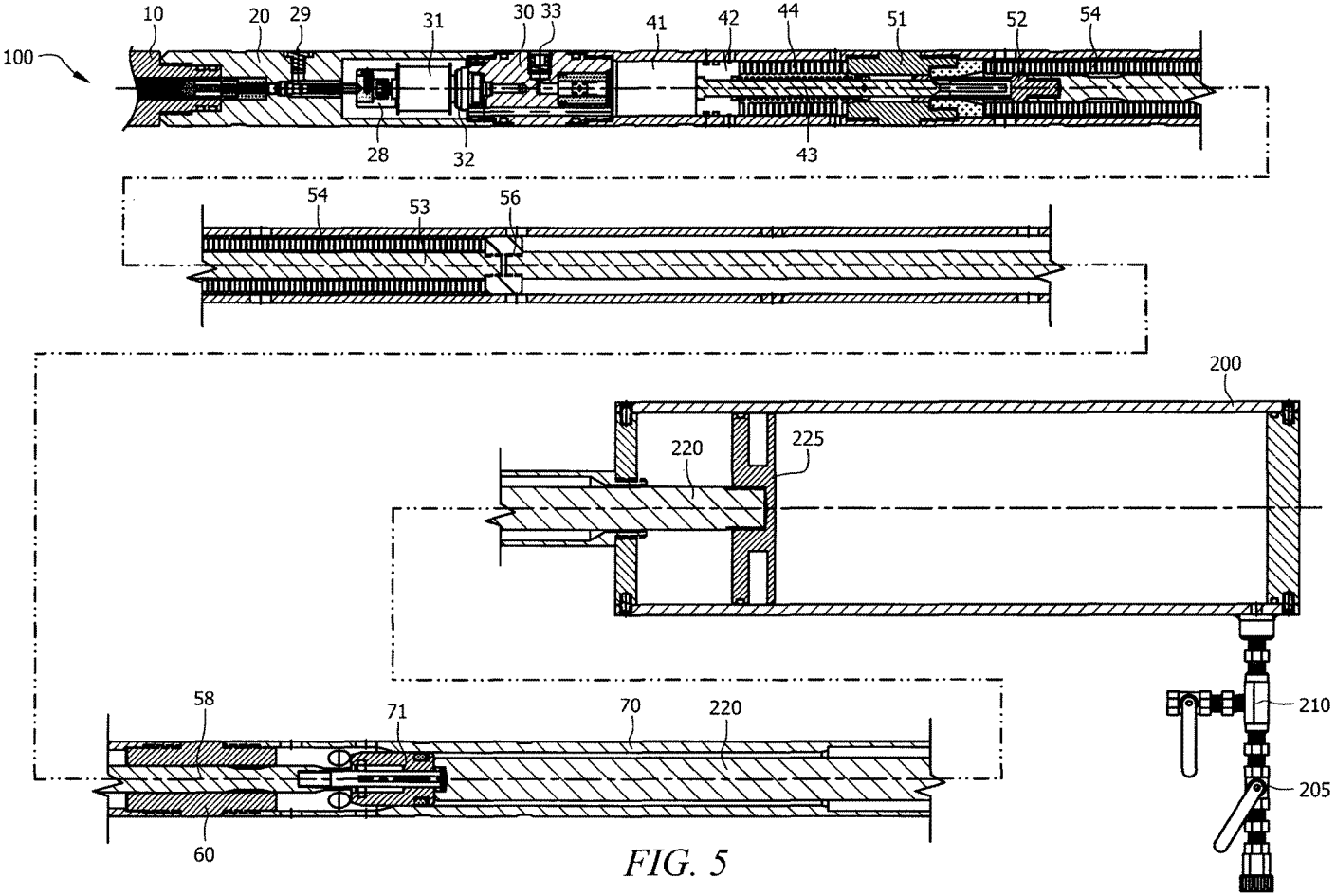
FIG. 5 schematically depicts the hybrid dump bailer and resetting tool of this invention once the tool case has been reset with the resetting tool.

Referring to FIG. 4, hybrid bailer 100 is now reset by attaching lower piston housing 70 to resetting tool 200. Resetting tool 200 includes inlet valve 205, relief valve 210, compression rod 220, and compression piston 225. Compression rod 220 is connected to compression piston 225 on one end and has a notch 215 that mates with the bottom of pressure pulse piston 71. Referring to FIG. 5, after resetting tool 200 is attached to the bailer, relief valve 210 is closed and inlet valve 205 is opened, allowing a high pressure fluid to be introduced into resetting tool 200. This fluid can be high pressure water, air, or any other fluid with sufficient pressure to force lower pressure pulse piston 71 up, thereby compressing pressure pulse piston spring 54 between connector 56 and collet base 55. Once pressure pulse piston spring 54 has been compressed, plug 33 is removed. A solenoid valve 32, which is normally closed, is energized to open so the hydraulic fluid can be pumped into head space 41 forcing piston 42 down, thereby compressing piston spring 44 and forcing rod 43 into collet 52. Once head chamber 41 is charged, plug 33 is replaced, inlet valve 205 is closed, and resetting tool 200 is removed. Once removed, relief valve 210 is opened to relieve the pressure in resetting tool 200. Finally, the bailer tubes can then be reattached and hybrid bailer 100 is ready to run again.

What is claimed is:

1. A hybrid dump bailer, comprising:

a tool body having a longitudinal tool bore;

at least one bailer tube;

the bore having a piston with a seal rod and a pressure pulse piston with a connector rod and a latch mechanism positioned therein, wherein the latch mechanism holds the seal rod and, upon application of a predetermined amount of force, releases the seal rod; and a lower connection mechanism to connect the tool body to said at least one bailer tube.

2. The dump bailer of claim 1, further comprising a piston spring and a pressure pulse piston spring.

3. The dump bailer of claim 2, wherein the bore has a head space above the piston.

4. The dump bailer of claim 3, further comprising a passageway to allow fluid communication between the head space and tool body.

5. The dump bailer of claim 4, further comprising a tandem sub and a fluted connector, wherein the fluted connector and the lower tandem sub limit travel of the pressure pulse piston.

6. The dump bailer of claim 5, further comprising a solenoid valve, wherein the solenoid valve is remotely openable to allow fluid communication between the head space and an upper solenoid housing of the solenoid valve.

7. The dump bailer of claim 1, further comprising a bailer cage and plug, wherein the plug is secured in the bailer cage by a shear pin.

8. The hybrid dump bailer of claim 1:

wherein the piston has the seal rod connected thereto, the piston slidably movable through the bore;

wherein the pressure pulse piston has the connector rod connected thereto, the pressure pulse piston slidably movable through the bore; and wherein the latch mechanism is positioned between the seal rod and the connector rod whereby upon application of the predetermined amount of force, the latch mechanism releases the connector rod and the pressure pulse piston advances to release cement.

9. A hybrid dump bailer, comprising:

a tool body-having a longitudinal tool bore;

at least one bailer tube;

a piston with a seal rod slidably positioned in the bore;

a pressure pulse piston with a connector rod slidably positioned in the bore;

a latch mechanism connected to the connector rod and holding the seal rod whereby, upon application of a predetermined amount of force, the latch mechanism releases the seal rod and the connector rod releases a material from the bailer tube; and a connection mechanism on the lower end of the tool body for connecting the tool body to said at least one bailer tube.

10. The dump bailer of claim 9, further comprising a piston spring and a pressure pulse piston spring.

11. The dump bailer of claim 10, wherein the tool body has a head space above the piston.

12. The dump bailer of claim 1, further comprising a solenoid valve base having a passageway therethrough, wherein the passageway allows fluid communication between the head space and solenoid valve housing.

13. The dump bailer of claim 12, wherein the tool body further comprises a fluted connector and a lower tandem sub, wherein the fluted connector and the lower tandem sub limit travel of the pressure pulse piston.

14. The dump bailer of claim 13, further comprising a solenoid valve and an upper solenoid valve, wherein the solenoid valve is remotely openable to allow fluid communication between the head space and an upper solenoid housing of the solenoid valve.

15. The dump bailer of claim 14, further comprising a bailer cage and a plug, wherein the plug is secured in the bailer cage by a shear pin.

16. The dump bailer of claim 9, further comprising a top contact sub, solenoid valve housing, solenoid valve base, inflow housing, metering collet sub, pressure chamber, lower tandem sub, and lower piston housing.

17. A method of introducing material into a well bore using a hybrid dump bailer, the dump bailer comprising a tool body having a longitudinal tool bore, at least one bailer tube, the bore having a piston with a seal rod and a pressure pulse piston with a connector rod and latch mechanism positioned therein, wherein the latch mechanism holds the seal rod and upon application of a predetermined amount of force releases the seal rod, and a lower connection mechanism to connect the tool body to said at least one bailer tube, the method comprising:

connecting the seal rod to the latch mechanism;

filling the bailer tube with the material to be introduced into the well bore;

connecting the bailer tube to the lower connection mechanism;

lowering the connected dump bailer into the well bore; and thereafter dumping the material into the well bore.

18. The method of claim 17; further comprising connecting a bailer cage to the bailer tube.

19. The method of claim 18, further comprising inserting a plug into the bailer cage and attaching the plug to the bailer cage with a shear pin.

20. A method of introducing material into a well bore, comprising:

providing a hybrid dump bailer comprising a tool body having a longitudinal tool bore, the tool body further comprising a lower connection mechanism and at least one bailer tube, the bore having a piston with a seal rod and a pressure pulse piston with a connector rod and latch mechanism positioned therein;

filling the bailer tube with the material to be introduced into the well bore;

connecting the bailer tube to the lower connection mechanism;

lowering the connected dump bailer into the well bore; and dumping the material into the well bore by applying a predetermined amount of force to the latch mechanism to release the seal rod.

21. The method of claim 20, further comprising connecting a bailer cage to the bailer tube.

22. The method of claim 21, further comprising inserting a plug into the bailer cage and attaching the plug to the bailer cage with a shear pin.

23. A method of resetting a hybrid dump bailer, the dump bailer comprising a tool body having a longitudinal tool bore, at least one bailer tube, the bore comprising a piston with a seal rod and a pressure pulse piston with a connector rod and latch mechanism, wherein the latch mechanism holds the seal rod and upon application of a predetermined amount of force, releases the seal rod, and a lower connection mechanism into connect the tool body to said at least one bailer tube, the method comprising:

connecting the lower connection mechanism to a resetting tool, wherein the resetting tool comprises an inlet valve, a relief valve, a compression piston and a compression rod;

connecting the inlet valve to a hydraulic fluid source;

closing the relief valve; and opening the inlet valve, thereby allowing hydraulic fluid to enter the resetting tool and force the compression piston and compression rod to move and force the pressure pulse piston and latch mechanism into position to receive the seal rod.

24. The method of claim 23, further comprising introducing a hydraulic fluid to force the piston with the seal rod into the latch mechanism.

25. A method of resetting a hybrid dump bailer, the dump bailer comprising a tool body having a longitudinal tool bore, the tool body further comprising a top contact sub, a solenoid valve housing, a solenoid valve base, an inflow housing, a metering latch sub, a pressure chamber, a lower tandem sub, and a lower piston housing; at least one bailer tube, the bore having a piston with a seal rod and a pressure pulse piston with a connector rod and latch mechanism positioned therein, wherein the latch mechanism holds the seal rod and, upon application of a predetermined amount of force, releases the seal rod, and a connection mechanism on the lower end of the tool body to connect the tool body to said at least one bailer tube, the method comprising:

connecting the lower connection mechanism to a resetting tool, wherein the resetting tool comprises an inlet valve, a relief valve, a compression piston and a compression rod;

connecting the inlet valve to a hydraulic fluid source;

closing the relief valve; and opening the inlet valve, thereby allowing hydraulic fluid to enter the resetting tool and force the compression piston and compression rod to move and force the pressure pulse piston and latch mechanism into position to receive the seal rod.

26. The method of claim 25, further comprising introducing a hydraulic fluid to force the piston with seal rod into the latch mechanism.

* * * * *